US007823412B2

(12) United States Patent
Jang et al.

(10) Patent No.: US 7,823,412 B2
(45) Date of Patent: Nov. 2, 2010

(54) HERMETIC VESSEL EQUIPPED WITH INSERTED-TYPE DISCHARGE PIPE, AND OIL SEPARATOR, GAS-LIQUID SEPARATOR, AND AIR CONDITIONING SYSTEM USING THE SAME

(75) Inventors: Won Jae Jang, Suwon-si (KR); Suk Ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 264 days.

(21) Appl. No.: 11/683,092

(22) Filed: Mar. 7, 2007

(65) Prior Publication Data

US 2007/0251264 A1 Nov. 1, 2007

(30) Foreign Application Priority Data

May 1, 2006 (KR) ..... 10-2006-0039257

(51) Int. Cl.
*F25B 23/00* (2006.01)

(52) U.S. Cl. ..... 62/467

(58) Field of Classification Search ..... 62/470; 55/459.1, 459.4

See application file for complete search history.

(56) References Cited

U.S. PATENT DOCUMENTS 3,823,793 A * 7/1974 Yamamoto ..... 181/200
5,029,448 A * 7/1991 Carey ..... 62/84
5,220,137 A * 6/1993 Howerton et al. ..... 181/264
6,131,405 A * 10/2000 Griffin et al. ..... 62/470
6,572,668 B1 * 6/2003 An et al. ..... 55/428

FOREIGN PATENT DOCUMENTS

| | | |
|---|---|---|
| CN | 1347294 | 5/2002 |
| CN | 1727816 | 2/2006 |
| JP | 10-185367 | 7/1998 |
| JP | 2002-213843 | 7/2002 |
| JP | 2004-97995 | 4/2004 |
| KR | 10-553558 | 2/2006 |

OTHER PUBLICATIONS

Chinese Office Action dated Oct. 10, 2008 issued in CN 2006-10093132.9.
Chinese Office Action issued Aug. 14, 2009 in CN Application No. 200610093132.9.

* cited by examiner

*Primary Examiner*—Frantz F Jules
*Assistant Examiner*—Cassey Bauer
(74) *Attorney, Agent, or Firm*—Stanzione & Kim, LLP

(57) ABSTRACT

A hermetic vessel capable of preventing noise caused by fluid flow, and an oil separator, a gas-liquid separator, and an air conditioning system using the same. The hermetic vessel having a vessel body includes an inlet through which a fluid flows into the vessel body, and a discharge pipe which is inserted into the vessel body to discharge the fluid. The discharge pipe includes a first discharge pipe which guides a flow of the fluid in a first direction and causes a wave of a higher frequency than an audible frequency, and a second discharge pipe which is connected to the first discharge pipe to guide a flow of the fluid from the first discharge pipe in a second direction which is different from the first direction.

6 Claims, 9 Drawing Sheets

HERMETIC VESSEL EQUIPPED WITH INSERTED-TYPE DISCHARGE PIPE, AND OIL SEPARATOR, GAS-LIQUID SEPARATOR, AND AIR CONDITIONING SYSTEM USING THE SAME

CROSS-REFERENCE TO RELATED APPLICATIONS

This application claims priority under 35 U.S.C. §119(a) from Korean Patent Application No. 2006-0039257, filed on May 1, 2006 in the Korean Intellectual Property Office, the disclosure of which is incorporated herein in its entirety by reference.

BACKGROUND OF THE INVENTION

1. Field of the Invention

The present general inventive concept relates to a hermetic vessel equipped with an inserted-type discharge pipe, and more particularly, to a hermetic vessel capable of reducing noise caused by fluid flow, and an oil separator, a gas-liquid separator, and an air conditioning system using the hermetic vessel.

2. Description of the Related Art

In general, a hermetic vessel equipped with an inserted-type discharge pipe is used in an air conditioning system to form a space for storing fluid or separating gas and liquid from each other. An oil separator or a gas-liquid separator mounted to a refrigerant pipe in the air conditioning system is an example of the hermetic vessel.

A conventional oil separator used in an air conditioning system is disclosed in Japanese Patent Laid-open Publication No. 2002-213843. As illustrated in FIG. 1, a conventional oil separator includes a hermetic vessel body 1, an inflow pipe 2 and a discharge pipe 3 which are inserted into the vessel body 1 through a top wall of the vessel body 1, and an oil pipe 4 which is connected to a bottom wall of the vessel body 1. An outlet of the inflow pipe 2 is directed along an inner peripheral surface of the vessel body 1 so that refrigerant entering the vessel body 1 can swirl.

The refrigerant entering the vessel body 1 through the inflow pipe 2 swirls inside the vessel body 1, and then is discharged through the discharge pipe 3. Thus, oil contained in the refrigerant collides with the inner peripheral surface of the vessel body 1 by a centrifugal force, and is separated from the refrigerant. The separated oil flows down along the inner peripheral surface of the vessel body 1, and is discharged through the oil pipe 4.

However, the conventional oil separator has a disadvantage in that noise is generated from the discharge pipe 3 because a powerful vortex is generated near an inlet of the discharge pipe 3 when the refrigerant swirling in the vessel body 1 is discharged through the discharge pipe 3. Because the vortex generated near the inlet of the discharge pipe 3 affects a standing wave which is generated in the discharge pipe 3 by the refrigerant flow, the noise is similar to a draining sound generated when the refrigerant is discharged. Further, the noise may be transferred to an outside oil separator through the discharge pipe 3.

SUMMARY OF THE INVENTION

The present general inventive concept provides a hermetic vessel equipped with an inserted-type discharge pipe capable of reducing noise caused by fluid flow, and an oil separator, a gas-liquid separator, and an air conditioning system using the hermetic vessel.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a hermetic vessel including a vessel body including an inlet through which a fluid flows into the vessel body, and a discharge pipe which is inserted into the vessel body to discharge the fluid, including a first discharge pipe which guides flow of the fluid in a first direction and causes a wave of a higher frequency than an audible frequency, and a second discharge pipe which is connected to the first discharge pipe to guide flow of the fluid from the first discharge pipe in a second direction which is different from the first direction.

The first discharge pipe may have opened ends, and may be connected to the second discharge pipe in a T-shaped configuration.

The first discharge pipe may have a diameter to a length ratio in the range of about 1:2 to 1:4.

The discharge pipe may include a curved portion at a connecting corner between the first discharge pipe and the second discharge pipe to smoothly discharge the fluid.

The foregoing and/or other aspects and utilities of the present general inventive concept are achieved by providing a hermetic vessel including a vessel body including an inlet through which a fluid flows into the vessel body, and a discharge pipe which is inserted into the vessel body to discharge the fluid, including a first discharge pipe which guides flow of the fluid in a first direction and has opened ends, and a second discharge pipe which is connected to the first discharge pipe to guide flow of the fluid from the first discharge pipe in a second direction which is different from the first direction.

The foregoing and/or other aspects and utilities of the present general inventive concept are achieved by providing a hermetic vessel including a vessel body including an inlet through which a fluid flows into the vessel body, and a discharge pipe which is inserted into the vessel body to discharge the fluid, including a first discharge pipe which guides flow of the fluid in a first direction and stabilizes flow of the fluid, and a second discharge pipe which is connected to the first discharge pipe to guide flow of the fluid from the first discharge pipe in a second direction which is different from the first direction.

The foregoing and/or other aspects and utilities of the present general inventive concept are achieved by providing an oil separator including a hermetic vessel, the hermetic vessel including an inlet through which a fluid flows into the hermetic vessel, a discharge pipe which is inserted into the hermetic vessel to discharge the fluid, and an oil pipe which is connected to a bottom wall of the hermetic vessel to discharge oil separated from the fluid, wherein the discharge pipe includes a first discharge pipe which guides flow of the fluid in a first direction and causes a wave of a higher frequency than an audible frequency, and a second discharge pipe which is connected to the first discharge pipe to guide flow of the fluid from the first discharge pipe in a second direction which is different from the first direction.

The foregoing and/or other aspects and utilities of the present general inventive concept are achieved by providing an oil separator including a hermetic vessel including an inlet through which fluid flows into the hermetic vessel, a discharge pipe which is inserted into the hermetic vessel to discharge the fluid, and an oil pipe which is connected to a bottom wall of the hermetic vessel to discharge oil separated from the fluid, wherein the discharge pipe includes a first discharge pipe which guides flow of the fluid in a first direction and has opened ends, and a second discharge pipe which is connected to the first discharge pipe to guide flow of the fluid from the first discharge pipe in a second direction which is different from the first direction.

The foregoing and/or other aspects and utilities of the present general inventive concept are achieved by providing an oil separator including a hermetic vessel including an inlet through which fluid flows into the hermetic vessel, a discharge pipe which is inserted into the hermetic vessel to discharge the fluid, and an oil pipe which is connected to a bottom wall of the hermetic vessel to discharge oil separated from the fluid, wherein the discharge pipe includes a first discharge pipe which guides flow of the fluid in a first direction and stabilizes flow of the fluid, and a second discharge pipe which is connected to the first discharge pipe to guide flow of the fluid from the first discharge pipe in a second direction which is different from the first direction.

The foregoing and/or other aspects and utilities of the present general inventive concept are achieved by providing a gas-liquid separator including a hermetic vessel including an inlet through which a gas-liquid mixed fluid flows into the hermetic vessel, and a discharge pipe which is inserted into the hermetic vessel to discharge a gas separated from the gas-liquid mixed fluid in the hermetic vessel, including a first discharge pipe which guides flow of the gas in a first direction and causes a wave of a higher frequency than an audible frequency, and a second discharge pipe which is connected to the first discharge pipe to guide flow of the gas from the first discharge pipe in a second direction which is different from the first direction.

The foregoing and/or other aspects and utilities of the present general inventive concept are achieved by providing a gas-liquid separator including a hermetic vessel including an inlet through which a gas-liquid mixed fluid flows into the hermetic vessel, and a discharge pipe which is inserted into the hermetic vessel to discharge a gas separated from the gas-liquid mixed fluid in the hermetic vessel, the discharge pipe including a first discharge pipe which guides flow of the gas in a first direction and has opened ends, and a second discharge pipe which is connected to the first discharge pipe to guide flow of the gas from the first discharge pipe in a second direction which is different from the first direction.

The foregoing and/or other aspects and utilities of the present general inventive concept are achieved by providing a gas-liquid separator including a hermetic vessel including an inlet through which a gas-liquid mixed fluid flows into the hermetic vessel, and a discharge pipe which is inserted into the hermetic vessel to discharge a gas separated from the gas-liquid mixed fluid in the hermetic vessel, the discharge pipe including a first discharge pipe which guides flow of the gas in a first direction and stabilizes flow of the gas, and a second discharge pipe which is connected to the first discharge pipe to guide flow of the gas from the first discharge pipe in a second direction which is different from the first direction.

The foregoing and/or other aspects and utilities of the present general inventive concept are achieved by providing an air conditioning system including a compressor to compress refrigerant and an oil separator to separate oil from the refrigerant discharged from the compressor, wherein: the oil separator includes a hermetic vessel, the hermetic vessel including an inlet through which the refrigerant flows into the hermetic vessel, a discharge pipe which is inserted into the hermetic vessel to discharge the refrigerant, and an oil pipe which is connected to a bottom wall of the hermetic vessel to supply oil separated from the refrigerant to the compressor, and the discharge pipe includes a first discharge pipe which guides flow of the refrigerant in a first direction and causes a wave of a higher frequency than an audible frequency, and a second discharge pipe which is connected to the first discharge pipe to guide flow of the refrigerant from the first discharge pipe in a second direction which is different from the first direction.

The foregoing and/or other aspects and utilities of the present general inventive concept are achieved by providing an air conditioning system including a compressor to compress refrigerant and an oil separator to separate oil from the refrigerant discharged from the compressor, wherein: the oil separator includes a hermetic vessel, the hermetic vessel including an inlet through which the refrigerant flows into the hermetic vessel, a discharge pipe which is inserted into the hermetic vessel to discharge the refrigerant, and an oil pipe which is connected to a bottom wall of the hermetic vessel to supply oil separated from the refrigerant to the compressor, and the discharge pipe includes a first discharge pipe which guides flow of the refrigerant in a first direction and has opened ends, and a second discharge pipe which is connected to the first discharge pipe to guide flow of the refrigerant from the first discharge pipe in a second direction which is different from the first direction.

The foregoing and/or other aspects and utilities of the present general inventive concept are achieved by providing an air conditioning system including a gas-liquid separator which is mounted to a refrigerant pipe and separates a gas refrigerant from a gas-liquid mixed refrigerant, wherein: the gas-liquid separator includes a hermetic vessel, the hermetic vessel including an inlet through which the gas-liquid refrigerant flows into the hermetic vessel, and a discharge pipe which is inserted into the hermetic vessel to discharge the gas refrigerant separated in the hermetic vessel, and the discharge pipe includes a first discharge pipe which guides flow of the gas refrigerant in a first direction and causes a wave of a higher frequency than an audible frequency, and a second discharge pipe which is connected to the first discharge pipe to guide flow of the gas refrigerant from the first discharge pipe in a second direction which is different from the first direction.

The foregoing and/or other aspects and utilities of the present general inventive concept are achieved by providing an air conditioning system including a gas-liquid separator which is mounted to a refrigerant pipe and separates a gas refrigerant from a gas-liquid mixed refrigerant, wherein: the gas-liquid separator includes a hermetic vessel, including an inlet through which the gas-liquid refrigerant flows into the hermetic vessel, and a discharge pipe which is inserted into the hermetic vessel to discharge the gas refrigerant separated in the hermetic vessel, and the discharge pipe includes a first discharge pipe which guides flow of the gas refrigerant in a first direction and has opened ends, and a second discharge pipe which is connected to the first discharge pipe to guide flow of the gas refrigerant from the first discharge pipe in a second direction which is different from the first direction.

BRIEF DESCRIPTION OF THE DRAWINGS

These and/or other aspects and advantages of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
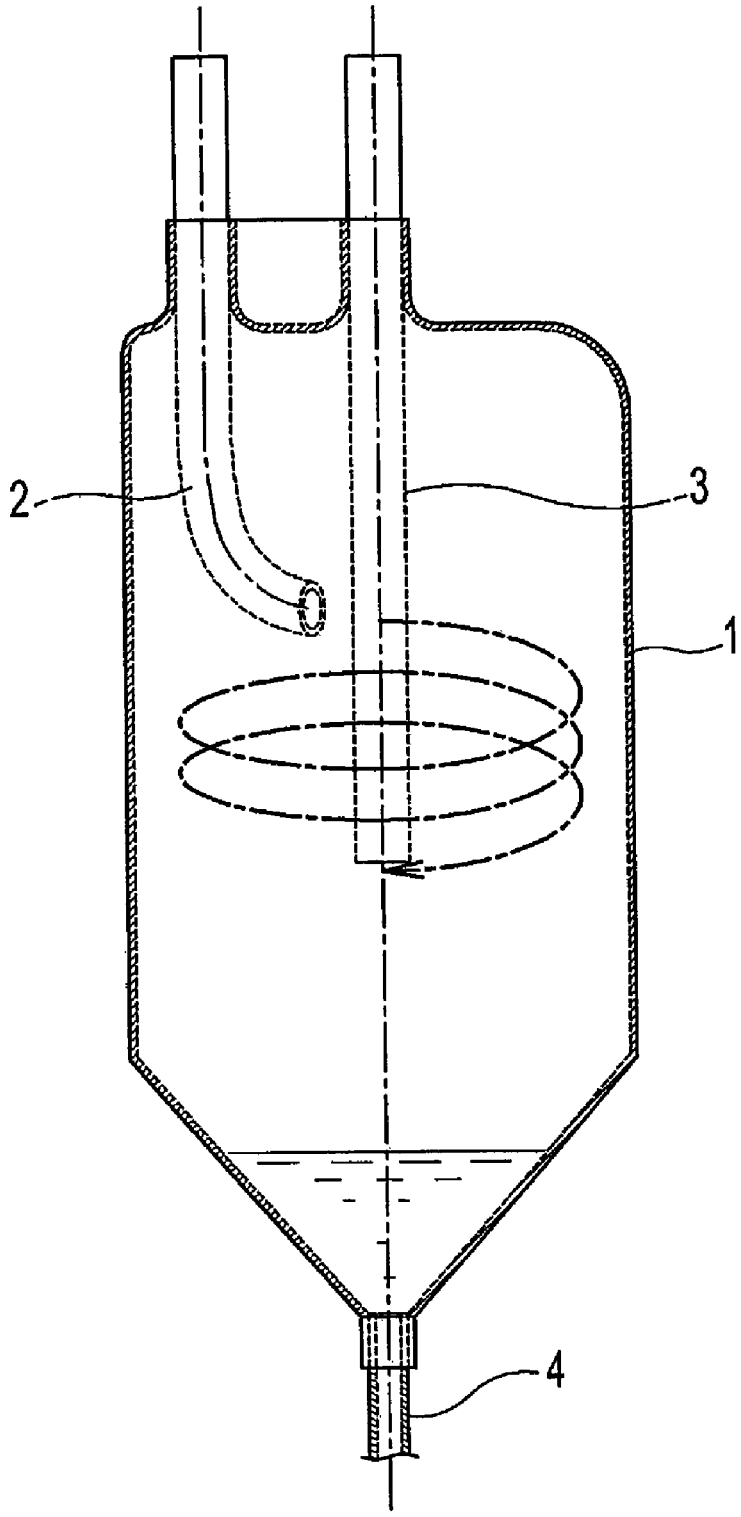
FIG. 1 (PRIOR ART)
FIG. 1 is a sectional view illustrating a conventional oil separator.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
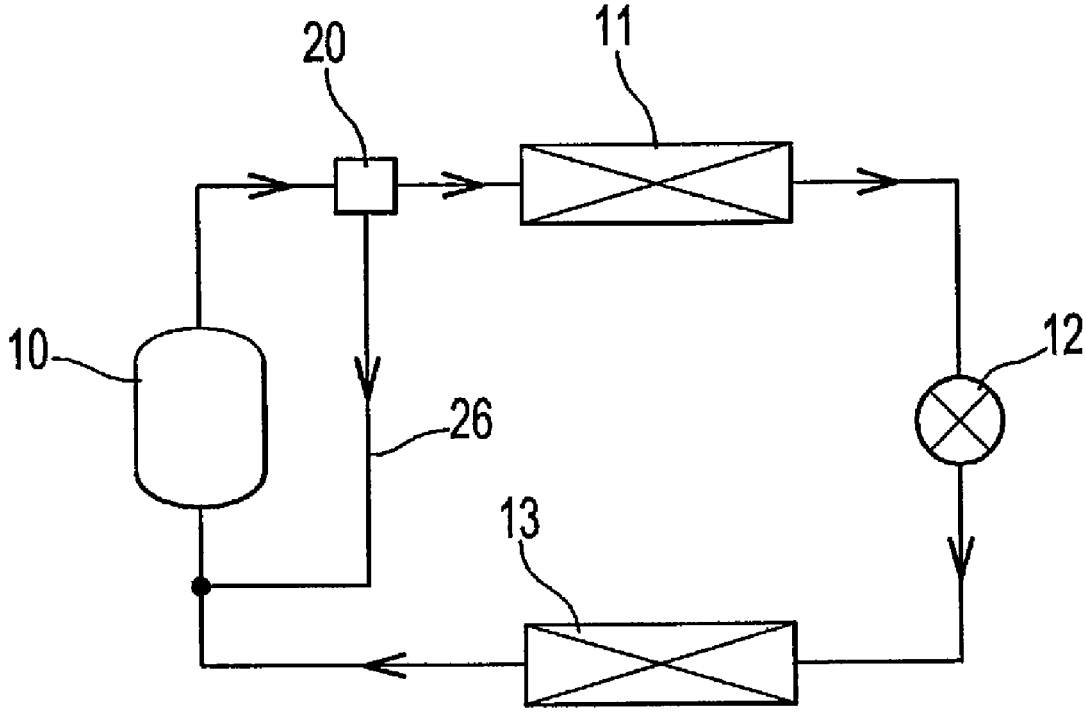
FIG. 2 is a schematic constitution view illustrating an air conditioning system which includes an oil separator using a hermetic vessel according to the present general inventive concept.

FIG. 2 is a schematic constitution view illustrating an air conditioning system which includes an oil separator using a hermetic vessel according to the present general inventive concept. The air conditioning system may include a compressor 10 to compress a refrigerant, a condenser 11 to condense the refrigerant discharged from the compressor 10 through a heat exchange, an expansion device 12 to expand the refrigerant condensed in the condenser 11 to a low pressure, and an evaporator 13 to evaporate the refrigerant passing through the expansion device 12 through a heat exchange.

The air conditioning system may further include an oil separator 20 to separate oil from the refrigerant discharged from the compressor 10 and to supply the oil to a suction side of the compressor 10 through an oil pipe 26. This is to prevent the oil from entering the condenser 11 with the refrigerant. If the oil enters into the condenser 11, a problem may occur in that a heat exchange performance of the condenser 11 may be deteriorated or a heat exchange efficiency may be decreased by a pressure drop.

Figure 3:
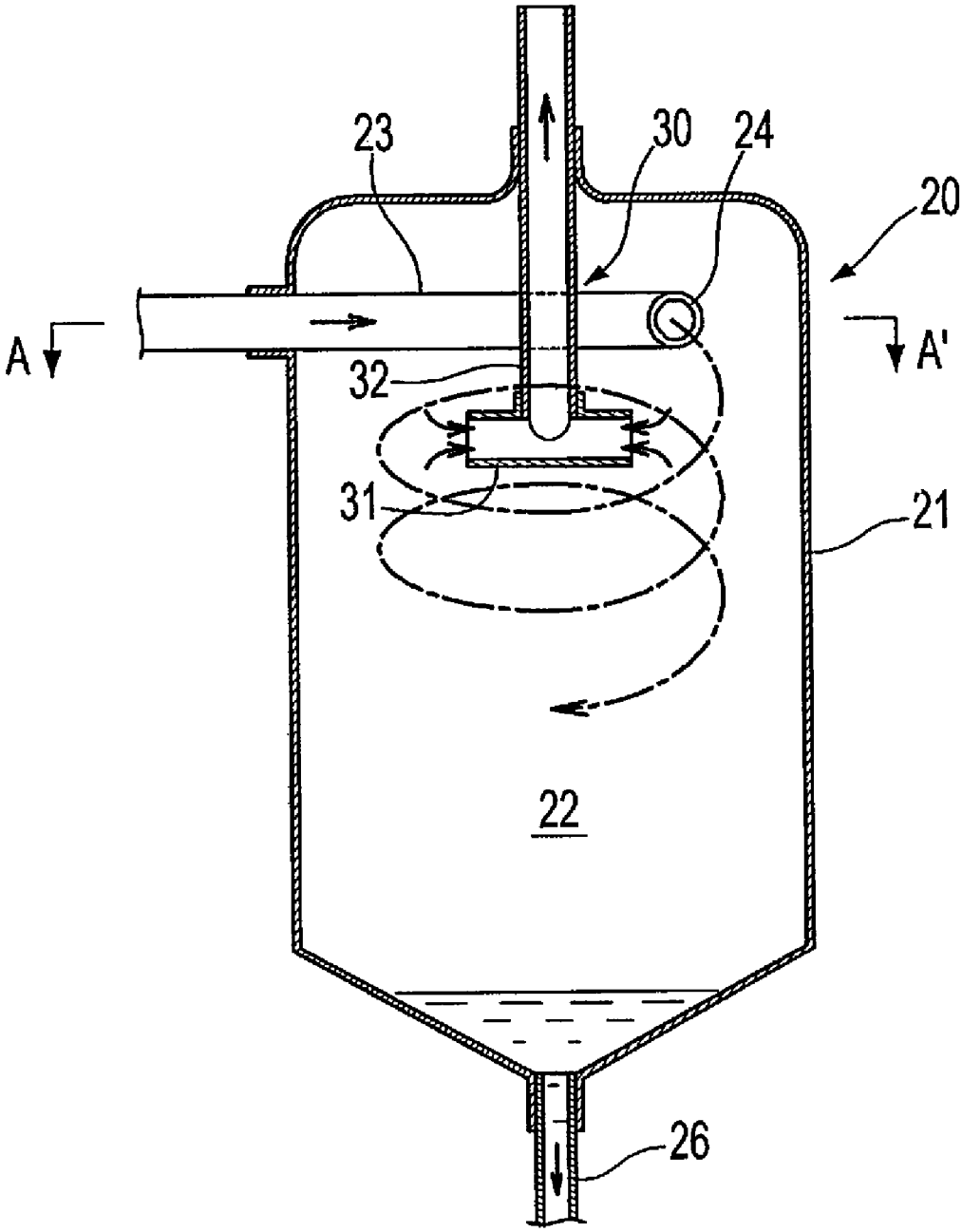
FIG. 3 is a sectional view illustrating the oil separator using the hermetic vessel of FIG. 2.
Figure 4:
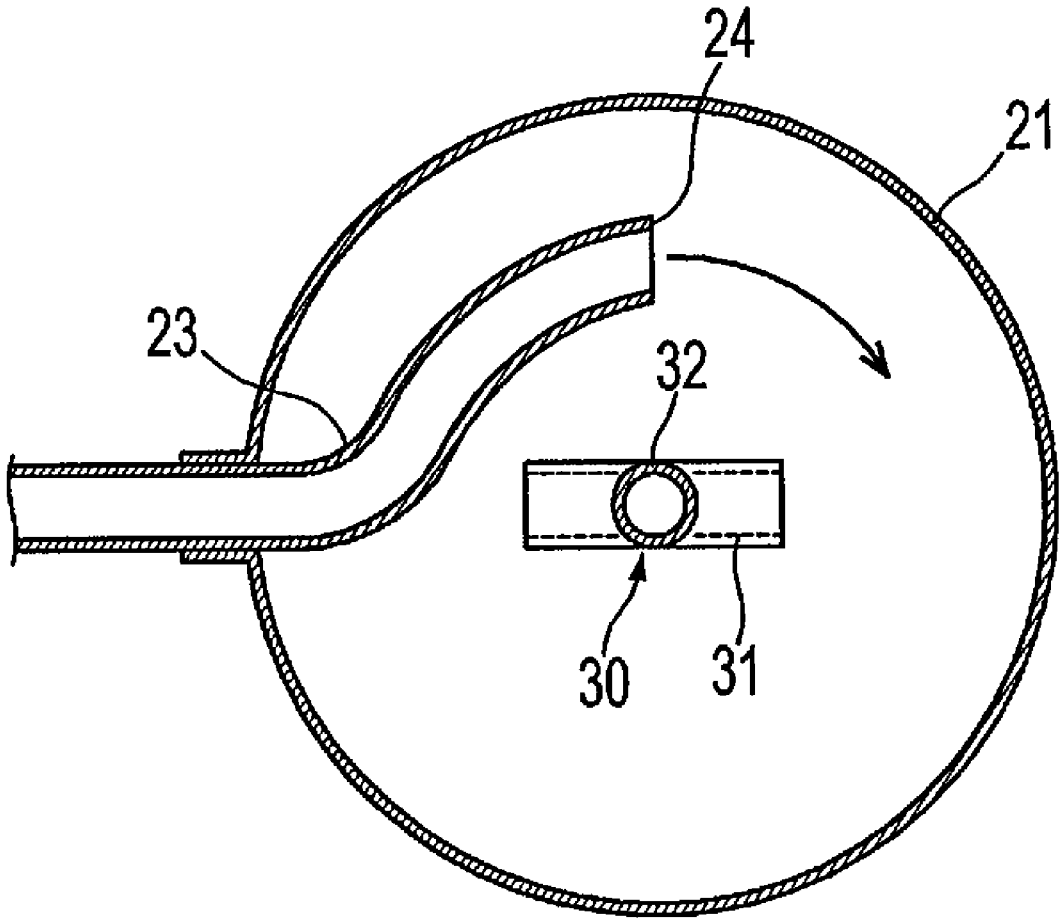
FIG. 4 illustrates a sectional view taken along a line A-A' in FIG. 3.

As illustrated in FIGS. 3 and 4, the oil separator 20 of FIG. 2 may include a hermetic vessel body 21 which defines an oil separating space 22, an inflow pipe 23 through which the refrigerant flows into the vessel body 21, a discharge pipe 30 through which the refrigerant is discharged from the vessel body 21, and the oil pipe 26 which is connected to a bottom wall of the vessel body 21 to discharge the oil therefrom.

The inflow pipe 23 is inserted into the vessel body 21 through a side of the vessel body 21. As illustrated in FIG. 4, the inflow pipe 23 is extended such that an outlet 24 of the inflow pipe 23 inside the vessel body 21 is directed along an inner peripheral surface of the vessel body 21 to swirl the refrigerant entering the vessel body 21. The discharge pipe 30 may be inserted into the vessel body 21 through a top wall of the vessel body 21.

The refrigerant entering the vessel body 21 swirls in the vessel body 21 and collides with the inner peripheral surface of the vessel body 21. The oil contained in the refrigerant is separated from the refrigerant by being adhered to the inner surface of the vessel body 21 through a centrifugal force caused by the swirling of the refrigerant inside the vessel body 21. Accordingly, a gas refrigerant, from which the oil is separated, is discharged through the discharge pipe 30. The oil separated from the refrigerant flows down along the inner peripheral surface of the vessel body 21, and is discharged through the oil pipe 26. Then, as illustrated in FIG. 2, the oil is supplied through the oil pipe 26 to the suction side of the compressor 10, and recovered in the compressor 10.

Figure 5:
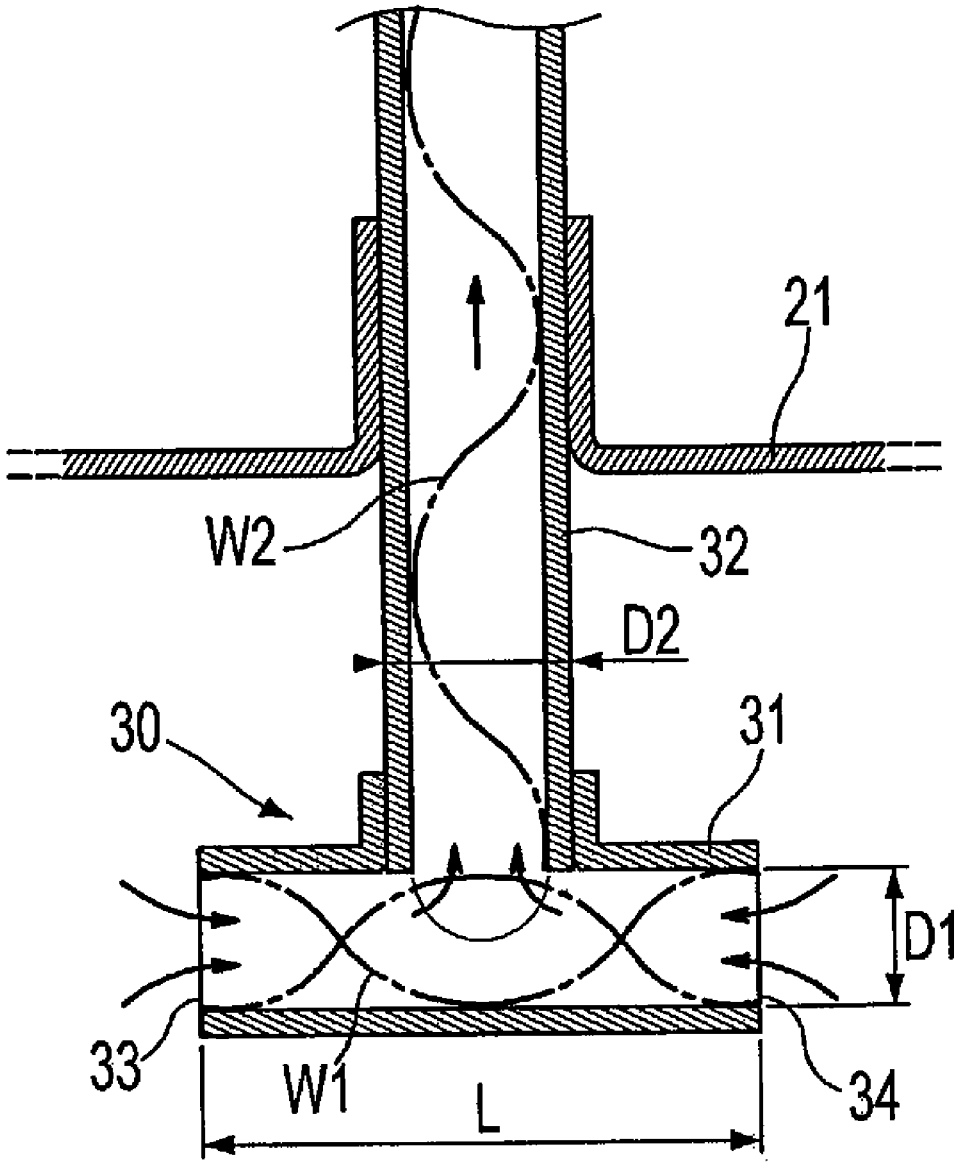
FIG. 5 is a sectional view illustrating a discharge pipe of the hermetic vessel of FIG. 3.

As illustrated in FIGS. 3 through 5, the discharge pipe 30 may include a first discharge pipe 31 and a second discharge pipe 32 coupled to the first discharge pipe 31 through which the refrigerant is discharged from the vessel body 21.

The first discharge pipe 31 may include a first inlet 33 and a second inlet 34 formed at respective ends thereof, through which the refrigerant can flow into the first discharge pipe 31. The second discharge pipe 32 may be inserted into the vessel body 21 through the top wall of the vessel body 21, and a lower end of the second discharge pipe 32 is communicatingly connected to the first discharge pipe 31. In other words, the discharge pipe 30 is structured by connecting the first discharge pipe 31 and the second discharge pipe 32 in a T-shaped configuration with an opening at the junction between the first discharge pipe 31 and the second discharge pipe 32. Accordingly, the refrigerant in the vessel body 21 flows into the first discharge pipe 31 in a first direction (a transverse direction) through the first and second inlets 33 and 34 formed at the ends of the first discharge pipe 31, and then is discharged through the second discharge pipe 32 in a second direction (an upper direction) which is different from the first direction.

The first discharge pipe 31 may have a length shorter than a length of the second discharge pipe 32 so that a frequency of a wave formed in the first discharge pipe 31 by the refrigerant flow can be higher than an audible frequency. Thus, a frequency of a standing wave W1 formed in the first discharge pipe 31 during the discharge of the refrigerant becomes higher than an audible frequency, so that audible noise is not generated.

Typically, as a pipe is shorter, a wavelength of a wave formed in the pipe becomes shorter and a frequency becomes higher. On the other hand, as a pipe is longer, a wavelength of a wave formed in the pipe becomes longer and a frequency becomes lower. For example, a musical instrument, like a pan pipe, generates a high-pitched sound from a relatively short pipe, and generates a low-pitched sound from a relatively long pipe. The present general inventive concept uses this principle.

In other words, by shortening a length L of the first discharge pipe 31, the wavelength of the standing wave W1 formed in the first discharge pipe 31 becomes short, and the frequency becomes higher than an audible frequency. Therefore, audible noise is not generated from the first discharge pipe 31 even when a heavy vortex is generated near the first and second inlets 33 and 34 during the discharge of the refrigerant.

Also, since the discharge pipe 30 of the present general inventive concept can be configured such that the ends of the first discharge pipe 31 are opened, a fluid inflow area of the discharge pipe 30 is larger then that of a discharge pipe 3 of the conventional oil separator illustrated in FIG. 1. Thus, the refrigerant in the vessel body 21 can flow into the discharge pipe 30 more smoothly. Further, since the refrigerant flow can be stabilized while the refrigerant passes through the first discharge pipe 31, the refrigerant can flow gently through the second discharge pipe 32.

Accordingly, a standing wave W2 formed in the second discharge pipe 32 by the refrigerant flow also does not generate audible noise, and the noise caused by the refrigerant flow passing through the second discharge pipe 32 can be minimized. As described above, noise is not generated from the first discharge pipe 31 because the frequency of the wave formed in the first discharge pipe 31 is higher than an audible frequency and, noise is not generated from the second discharge pipe 32 in which the refrigerant flow is stabilized.

In order to realize the above effects, a ratio of a diameter D1 to a length L of the first discharge pipe 31 can be set to be in the range of about 1:2 to 1:4. If the length of the first discharge pipe 31 is too short, it is difficult to stabilize the refrigerant flow through the first discharge pipe 31. If the length of the first discharge pipe 31 is too long, it is difficult to make the frequency of the wave formed in the first discharge pipe 31 higher than an audible frequency. Therefore, in order to enable the frequency of the wave formed in the first discharge pipe 31 to be higher than the audible frequency and the first discharge pipe 31 to stabilize the refrigerant flow, the ratio of the diameter D1 to the length L of the first discharge pipe 31 may be in the range of about 1:2 to 1:4. The diameter D1 of the first discharge pipe 31 may also be equal to a diameter D2 of the second discharge pipe 32.

Figure 6:
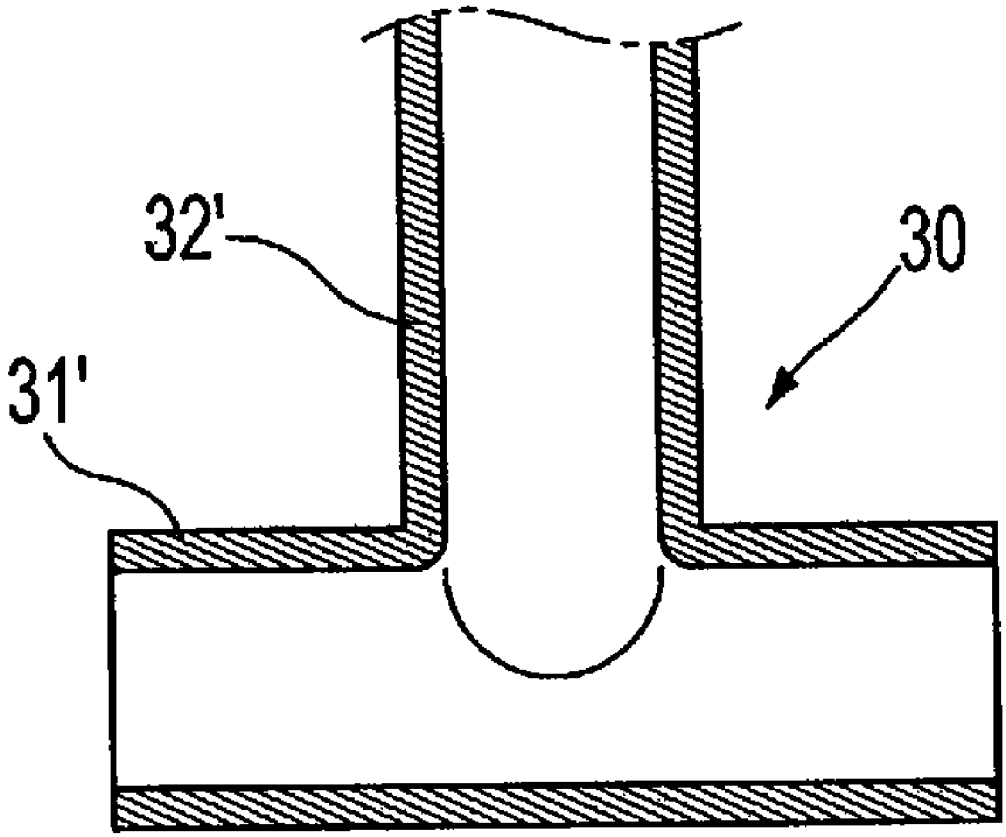
FIGS. 6 and 7 are sectional views illustrating other embodiments of a discharge pipe of a hermetic vessel according to the present general inventive concept.

When manufacturing the discharge pipe 30, the lower end of the second discharge pipe 32 may be coupled to the first discharge pipe 31 formed in a T-shaped socket type (see FIG. 5), or a first discharge pipe 31' and a second discharge pipe 32' may be integrally connected to each other by welding as illustrated in FIG. 6.

Figure 7:
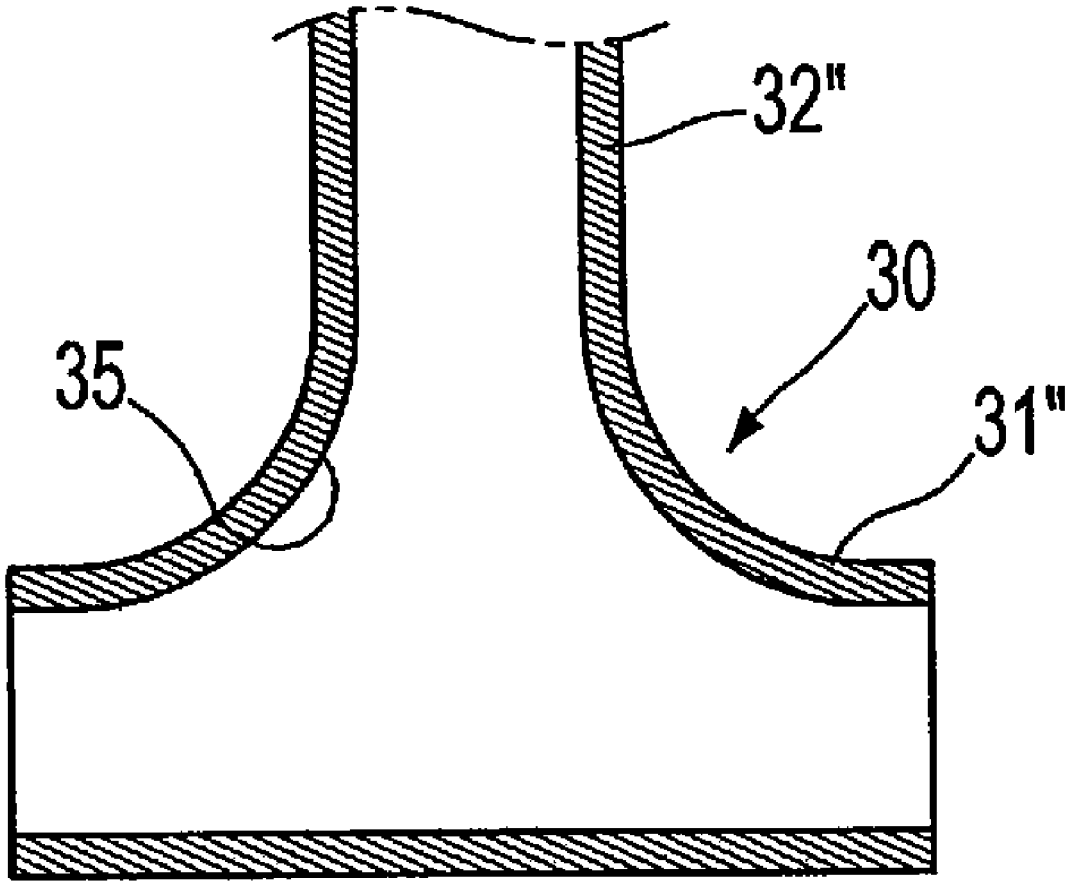

Also, as illustrated in FIG. 7, a curved portion 35 may be formed at a connecting corner between a first discharge pipe 31" and a second discharge pipe 32". According to the embodiment illustrated in FIG. 7 a fluid, such as a refrigerant gas, directed from the first discharge pipe 31" to the second discharge pipe 32" can flow more gently by being guided by the curved portion 35, thereby further reducing the flow noise.

Figure 8:
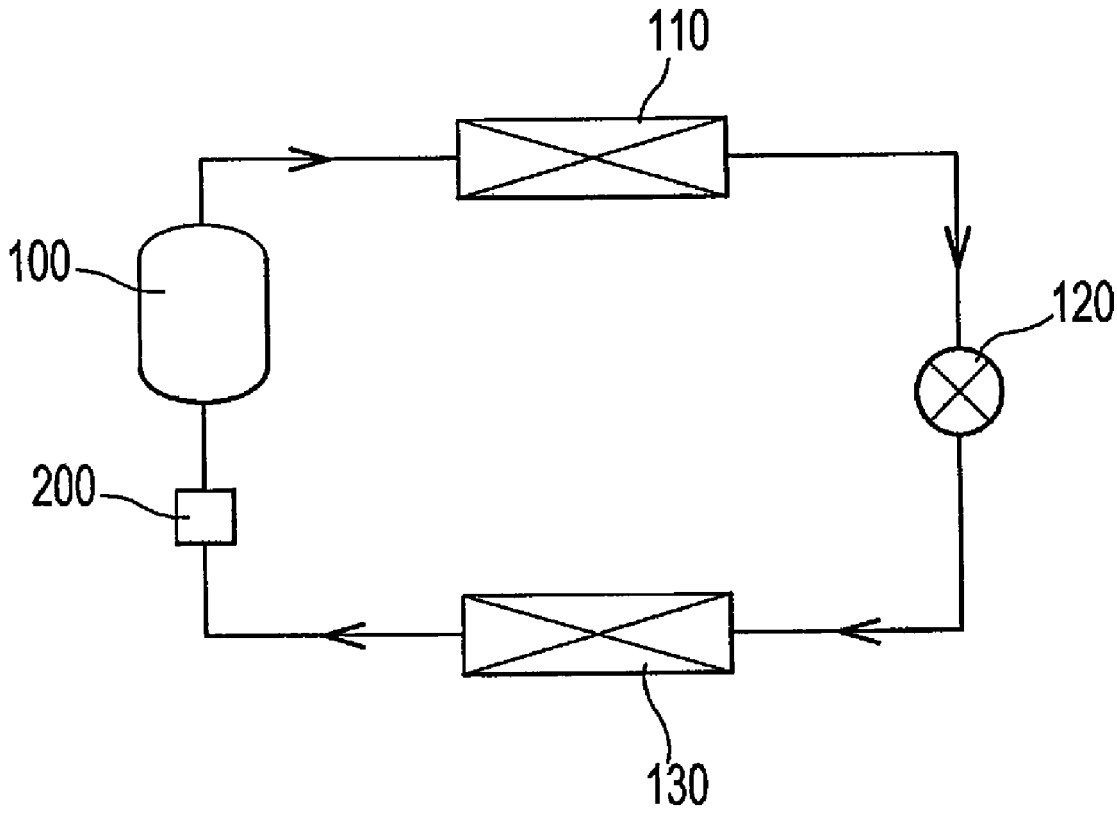
FIG. 8 is a schematic constitution view illustrating an air conditioning system which includes a gas-liquid separator using a hermetic vessel according to the present general inventive concept.
Figure 9:
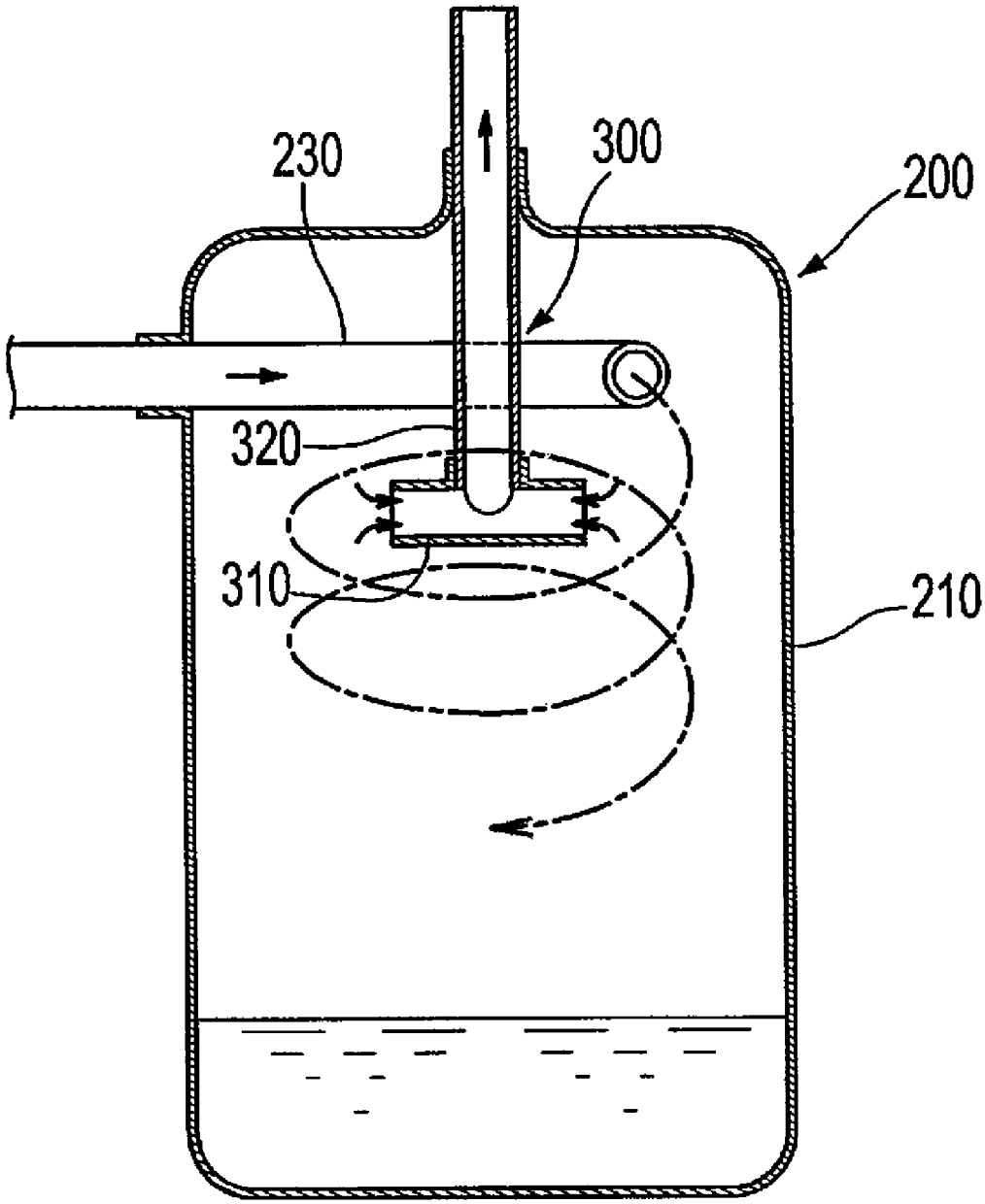
FIG. 9 is a sectional view illustrating the gas-liquid separator using the hermetic vessel of FIG. 8.

FIG. 8 is a schematic constitution view illustrating an air conditioning system which includes a gas-liquid separator using a hermetic vessel according to the present general inventive concept, and FIG. 9 is a sectional view illustrating the gas-liquid separator using the hermetic vessel of FIG. 8. As illustrated in FIG. 8, an air conditioning system may include a compressor 100, a condenser 110, an expansion device 120 and an evaporator 130. The air conditioning system may further include a gas-liquid separator 200 which separates a gas refrigerant from a gas-liquid mixed refrigerant discharged from the evaporator 130 and supplies the separated gas refrigerant to the compressor 100. The gas-liquid separator 200 supplies the gas refrigerant to the compressor 100 and prevents a malfunction or overload of the compressor 100 which may be caused by the inflow of a liquid refrigerant into the compressor 100.

As illustrated in FIG. 9, the gas-liquid separator 200 may include a hermetic vessel body 210, an inflow pipe 230, and a discharge pipe 300 which may have a first discharge pipe 310 and a second discharge pipe 320.

A structure of the gas-liquid separator 200 is similar to the structure of the oil separator 20 illustrated in FIG. 3, exclusive of the oil discharge pipe 26.

In the gas-liquid separator 200, the gas-liquid mixed refrigerant flowing into the vessel body 210 through the inflow pipe 230 swirls inside the vessel body 210, whereby the liquid refrigerant is separated by a centrifugal force. Therefore, only the gas refrigerant is discharged through the discharge pipe 300. The liquid refrigerant gathers at the bottom of the vessel body 210, and is then evaporated and discharged through the discharge pipe 300. The discharge pipe 300 of the gas-liquid separator 200 may also include a first discharge pipe 310 and a second discharge pipe 320 configured similarly to the embodiments illustrated in FIGS. 3-7, so that audible noise caused by the gas refrigerant flow is not generated.

While the hermetic vessel equipped with the inserted-type discharge pipe illustrated in FIGS. 3-9 is applied to the oil separator 20 or the gas-liquid separator 200 of the air conditioning system, the present general inventive concept is not limited thereto, and the hermetic vessel equipped with the inserted-type discharge pipe according to the present general inventive concept can also be applied to a variety of equipment for a fluid-circulating structure which generate noise when a fluid is discharged through a discharge pipe inserted into a vessel body to prevent the flow noise.

According to the present general inventive concept, since a discharge pipe which is inserted into a hermetic vessel includes a first discharge pipe to guide a fluid in a first direction and a second discharge pipe to guide the fluid in a second direction which is different from the first direction, and a frequency of the wave formed in the first discharge pipe by the fluid flow becomes higher than an audible frequency, the noise caused by the fluid flow can be minimized.

Also, since a fluid flow, such as a refrigerant flow, can be stabilized while the fluid passes through a first discharge pipe and the fluid flows gently in a second discharge pipe, a flow noise at the second discharge pipe can be minimized. Accordingly, audible noise may not be generated at the second discharge pipe as well as in the first discharge pipe.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An oil separator including a hermetic vessel, the hermetic vessel comprising:

a vessel body;

an inflow pipe through which a fluid flows into the vessel body, the inflow pipe being inserted in the vessel body through a side of the vessel body and an outlet of the inflow pipe inside the vessel body being directed along an inner peripheral surface of the vessel body to swirl the fluid entering the vessel body:

a discharge pipe which is inserted into the vessel body to discharge the fluid; and an oil pipe which is connected to a bottom wall of the vessel body to discharge oil separated from the fluid, wherein the discharge pipe comprises:

a first discharge pipe which guides flow of the fluid in a first direction, and a second discharge pipe which is connected to the first discharge pipe to guide flow of the fluid from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

2. An oil separator including a hermetic vessel, the hermetic vessel comprising:

a vessel body;

an inflow pipe through which fluid flows into the vessel body, the inflow pipe being inserted in the vessel body through a side of the vessel body and an outlet of the inflow pipe inside the vessel body being directed along an inner peripheral surface of the vessel body to swirl the fluid entering the vessel body;

a discharge pipe which is inserted into the vessel body to discharge the fluid; and an oil pipe which is connected to a bottom wall of the vessel body to discharge oil separated from the fluid, wherein the discharge pipe comprises:

a first discharge pipe which guides flow of the fluid in a first direction and has opened ends, and a second discharge pipe which is connected to the first discharge pipe to guide flow of the fluid from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

3. An oil separator including a hermetic vessel, the hermetic vessel comprising:

a vessel body;

an inflow pipe through which fluid flows into the vessel body, the inflow pipe being inserted in the vessel body through a side of the vessel body and an outlet of the inflow pipe inside the vessel body being directed along an inner peripheral surface of the vessel body to swirl the fluid entering the vessel body;

a discharge pipe which is inserted into the vessel body to discharge the fluid; and an oil pipe which is connected to a bottom wall of the vessel body to discharge oil separated from the fluid, wherein the discharge pipe comprises:

a first discharge pipe which guides flow of the fluid in a first direction and stabilizes flow of the fluid, and a second discharge pipe which is connected to the first discharge pipe to guide flow of the fluid from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

4. An air conditioning system including a compressor to compress refrigerant and an oil separator to separate oil from the refrigerant discharged from the compressor, wherein:

the oil separator comprises a hermetic vessel, the hermetic vessel comprising:

a vessel body, an inflow pipe through which the refrigerant flows into the vessel body, the inflow pipe being inserted in the vessel body through a side of the vessel body and an outlet of the inflow pipe inside the vessel body being directed along an inner peripheral surface of the vessel body to swirl the fluid entering the vessel body, a discharge pipe which is inserted into the vessel body to discharge the refrigerant, and an oil pipe which is connected to a bottom wall of the vessel body to supply oil separated from the refrigerant to the compressor, and the discharge pipe comprises:

a first discharge pipe which guides flow of the refrigerant in a first direction, and a second discharge pipe which is connected to the first discharge pipe to guide flow of the refrigerant from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

5. An air conditioning system including a compressor to compress refrigerant and an oil separator to separate oil from the refrigerant discharged from the compressor, wherein:

the oil separator comprises a hermetic vessel, the hermetic vessel comprising:

a vessel body;

an inflow pipe through which the refrigerant flows into the vessel body, the inflow pipe being inserted in the vessel body through a side of the vessel body and an outlet of the inflow pipe inside the vessel body being directed along an inner peripheral surface of the vessel body to swirl the fluid entering the vessel body, a discharge pipe which is inserted into the vessel body to discharge the refrigerant, and an oil pipe which is connected to a bottom wall the vessel body to supply oil separated from the refrigerant to the compressor, and the discharge pipe comprises:

a first discharge pipe which guides flow of the refrigerant in a first direction and has opened ends, and a second discharge pipe which is connected to the first discharge pipe to guide flow of the refrigerant from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

6. An air conditioning system including a gas-liquid separator which is mounted to a refrigerant pipe and separates gas refrigerant from a gas-liquid mixed refrigerant, wherein:

the gas-liquid separator comprises a hermetic vessel, the hermetic vessel comprising:

a vessel body, an inflow pipe through which the gas-liquid refrigerant flows into the vessel body, the inflow pipe being inserted in the vessel body through a side of the vessel body and an outlet of the inflow pipe inside the vessel body being directed along an inner peripheral surface of the vessel body to swirl the fluid entering the vessel body, and a discharge pipe which is inserted into the vessel body to discharge the gas refrigerant separated in the vessel body, and the discharge pipe comprises:

a first discharge pipe which guides flow of the gas refrigerant in a first direction, and a second discharge pipe which is connected to the first discharge pipe to guide flow of the gas refrigerant from the first discharge pipe in a second direction which is different from the first direction, wherein the first discharge pipe is connected to the second discharge pipe in a T-shaped configuration which has a ratio of a diameter to a length in the range of about 1:2 to 1:4 such that a ratio of a length of the first pipe to a length of the second pipe and a ratio of the diameter of the first pipe to the length of the first pipe causes a wave of a higher frequency than an audible frequency.

* * * * *